United States Patent [19]

von Linde et al.

[11] 4,113,425

[45] Sep. 12, 1978

[54] BURNER FOR FLUID FUELS

[75] Inventors: Robert von Linde; Joachim von Linde, both of Graefelfing; German Kurz, Karlsfeld, all of Germany

[73] Assignee: Caloric Gesellschaft Fuer Apparatebau m.b.H, Germany

[21] Appl. No.: 690,617

[22] Filed: May 27, 1976

[30] Foreign Application Priority Data

May 30, 1975 [DE] Fed. Rep. of Germany ..... 2524036

[51] Int. Cl.[2] ..... F23D 15/02

[52] U.S. Cl. ..... 431/352; 60/39.65; 431/173

[58] Field of Search ..... 431/158, 351, 352, 10, 431/173; 110/28 F; 60/39.65

[56] References Cited

U.S. PATENT DOCUMENTS

| | | | |
|---|---|---|---|
| 703,768 | 7/1902 | Corrigan | 431/173 |
| 2,206,553 | 7/1940 | Nagel | 431/10 |
| 2,918,118 | 12/1959 | Schirmer | 431/352 |
| 3,228,451 | 6/1966 | Fraser et al. | 431/352 |
| 3,352,345 | 11/1967 | McLendon | 431/352 |
| 3,368,604 | 2/1968 | Mutchler | 431/352 |
| 3,804,578 | 4/1974 | Robbins | 431/351 |
| 3,851,466 | 12/1974 | Verdouw | 60/39.65 |
| 3,946,553 | 3/1976 | Roberts et al. | 60/39.35 |
| 3,951,584 | 4/1976 | Thekdi | 431/173 |
| 3,982,392 | 9/1976 | Crow | 431/173 |

*Primary Examiner*—Edward G. Favors
*Attorney, Agent, or Firm*—Kane, Dalsimer, Kane, Sullivan and Kurucz

[57] ABSTRACT

This invention refers to a burner for fluid fuels comprising an essentially cylindrical burner housing having an open end and a closed end, the open end being connectable to an exhaust pipe, a fuel supply means in the closed end in the longitudinal center axis of the housing, a combustion air supply passage in the peripheral wall of the housing, a tubular combustion chamber arranged co-axially within the housing, an annular space between said combustion chamber and the inner peripheral wall of the housing an annular space, said space being closed towards the open end of the housing, said air supply passage opening into said annular space.

10 Claims, 3 Drawing Figures

BURNER FOR FLUID FUELS

BACKGROUND OF THE INVENTION

When burners for fluid fuels are provided as high speed burners with an output of approximately 100.000.000 Kcal/m$^3$h considerable thermal problems arise. Although the combustion chamber is cooled at its outer surface by the combustion air this cooling is not sufficient at higher loads so that usually a ceramic lining must be provided. Such lining increases the price of the burner and has the disadvantage that in some fields of application, f.i. burning of waste, the lining is attacked by the salts generated by the combustion such as sodium compounds and vanadium compounds. Besides this, high speed burners often suffer from starting difficulties which necessitate expensive start or pilot burners instead of the usual spark electrodes.

SUMMARY OF THE INVENTION

It is the object of the invention to provide a burner of the type set forth which is of simple construction and yet capable of high thermal loading without requiring a ceramic lining for the combustion chamber, and which enables complete combustion and easy starting.

With this and other objects in mind the invention proposes a combustion chamber in the shape of a double cone or frustrum having its largest diameter between its ends, a separation between the end of the double cone adjacent the fuel supply means and the peripheral wall to form a prechamber comprising said fuel supply means and an ignition means, holes in said separation and in the wall of the double cone, whereby the air supply passage is arranged in such manner that its longitudinal axis includes an angle with a radial line passing through the center of the combustion chamber and the intersection between the longitudinal axis of said passage and the inner wall of the housing.

This proposal enables cooling by the combustion air of the outer surface as well as of the inner surface of the combustion chamber formed by the double cone. Thereby an air veil is formed at the inner wall which provides an effective protection of the wall of the double cone against the hot combustion gases. As a result of the non-radial introduction into the annular space between the double cone and the peripheral wall of the housing, the combustion air flows with a rotary motion on one hand along the outer surface towards the closed end of the housing, and on the other hand along the inner surface of the double cone an effective cooling is safeguarded. Furthermore, because of the rotation of the air within the double cone, the cooler and, therefore, heavier air is always in the radial outer zone of the combustion chamber i.e. adjacent its inner wall. When the air becomes lighter as it is heated up by the combustion gases the lighter air will be urged radially inwardly by the following cooler air with the effect that always cold air is flowing along the inner wall of the double cone. Accordingly, the cooling effect is always maintained.

The very effective cooling of the wall of the combustion chamber allows the wall to be relatively thin and to be made of cheap low alloyed steels. In addition thereto, surprisingly, a considerably improved combustion and starting is obtained. It is known that a good mixing of combustion air and fuel is a condition for complete combustion. By the present proposal by which at first only that part of the combustion air which flows through the holes in the separation comes in contact with the fuel a rich fuel-air mixture which is readily ignitible is formed in the region of the spark electrodes and, initially, a partial combustion takes place. With liquid fuel, the heat of this partial combustion leads to a pre-vaporization of that part of the fuel which has not yet been ignited, and with gaseous fuel, a cracking of the molecules takes place. Following this, the partially combusted fuel enters the double cone and burns completely with the combustion air entering through the holes in the wall of the double cone. This step-wise combustion is very favorable with respect to the formation of $NO_x$ which has been measured in the order of 100 ppm.

As mentioned above with the present device a peripheral flow of air along the outer surface as well as along the inner surface of the double cone takes place. As the flame cone which contains also unburnt fuel participates in the rotation of the air within the double cone it may happen with liquid fuel, such as oil, that at high circumferential speeds, fuel droplets are thrown by centrifugal force against the inner wall of the double cone whereby combustion is deteriorated. With a thin-walled double cone it is, therefore, preferred to incline the air holes in the wall of the double cone against the direction of flow of the air within the annular space thereby decreasing the circumferential speed of the air within the double cone. The circumferential speed can also be controlled by suitable selection of the inflow angle of the air into the annular space.

That part of the combustion air which flows through the holes in the separation is likewise rotating, and the fuel injected into this part of the air participates in this rotation. If the rotational speed is too great unburnt fuel droplets may be thrown against the inner wall of the double cone. In order to decrease the rotational speed of this part of the combustion air an axially extending baffle can be arranged within the annular space. This baffle extends preferably from the separation so that the rotation air flow is slowed down not earlier than immediately before entry into the pre-chamber so that the cooling of the outer surface of the double cone is not affected. An additional baffle can be arranged on the other end of the annular space in opposite relationship to the first baffle.

The combustion air supply passage should open into the annular space near the end adjacent to the open end of the burner housing so that the whole length of the combustion chamber is cooled by the combustion air. In this connection, it is preferred to provide holes in the wall of the double cone near the end thereof which is adjacent to the open end of the housing, which holes are arranged about the circumference. Air passes through these openings and flows within the double cone towards the open end of the housing whereby this part of the combustion chamber which has a particular high thermal loading is effectively cooled.

The wall closing the annular space at the end opposite to the separation may be a ceramic plate or a cooled metallic body.

DETAILED DESCRIPTION

Figure 1:
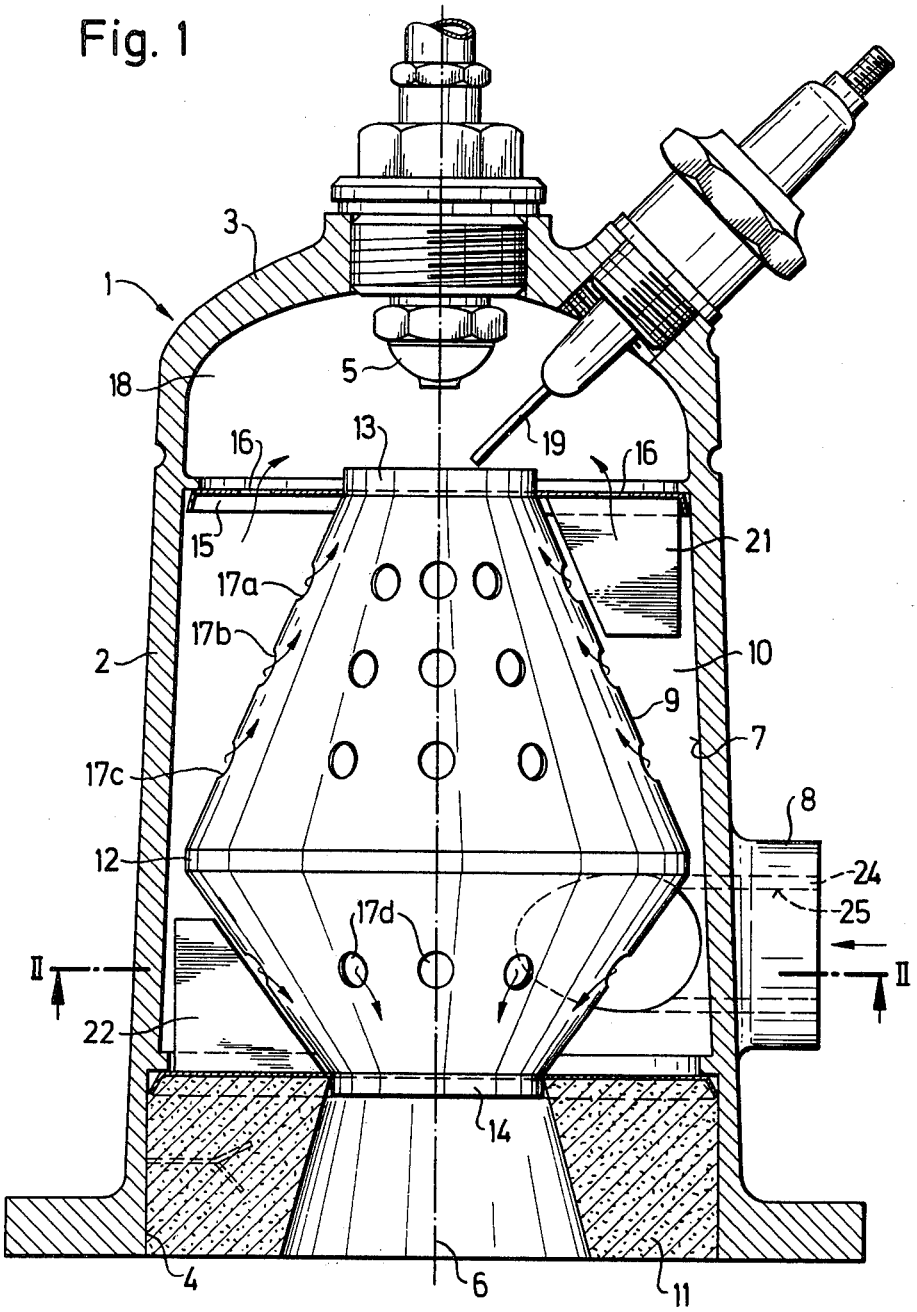
FIG. 1 is a longitudinal sectional view of an oil burner in accordance with the invention.

The burner shown in the drawings comprises a burner housing 1 having a cylindrical peripheral wall 2 and which is closed at one end by an end wall 3. The other end 4 is open and in communication with an exhaust pipe (not shown) or a furnace. A fuel nozzle 5 is arranged in the end wall 3 in alignment with the longitudinal center axis 6 of the housing 1. An intake passage 8 for combustion air opens tangentially in the inner surface 7 of peripheral wall 2. A tubular combustion chamber 9 is arranged within housing 1 co-axially to longitudinal axis 6. The combustion chamber 9 forms together with the inner surface of peripheral wall 2 an annular space 10 which is closed by an annular plate 11 towards the open end 4 of housing 1.

The combustion chamber 9 has the shape of a double cone having its largest diameter between its ends 12 and 13. A separation 15 is arranged between the end 13 adjacent the fuel nozzle 5 and the peripheral wall 2 of the housing 1. This separation 15 is provided with holes 16, is substantially perpendicular to the longitudinal axis of the combustion chamber 9, and is separate from the burner housing. Also the wall of the combustion chamber 9 is provided with rows of holes 17*a*, 17*b*, 17*c* and 17*d* which are uniformly distributed about the circumference of combustion chamber 9. A spark electrode 19 extends into the pre-chamber 18 formed between the separation 15 and the endwall 3 of the housing 1.

The combustion air delivered by a blower (not shown) to intake passage 8 enters the annular space 10 tangentially and flows in a helical path along the outer surface of combustion chamber 9 towards the pre-chamber 18. A part of the air enters the pre-chamber 18 through the holes 16 in separation 15, and the other part enters the interior of combustion chamber 9 through the holes 17*a*, 17*b*, 17*c* and 17*d*. The rotational motion of the air entering through the holes 17*a*, 17*b*, 17*c* and 17*d* is partially maintained within the combustion chamber 9 so that an air veil is formed along the inner surface of the combustion chamber 9. The size of the holes 16 and 17 is chosen such that the air entering pre-chamber 18 through the holes 16 forms a rich fuel-air mixture with the fuel injected through nozzle 5 which mixture is readily ignitible and which, therefore, can be easily ignited by the spark electrode 19. As a result of the rotational motion of the air entering pre-chamber 18, the flame also spreads rotationally within the combustion chamber 9 and does not at this stage enable complete combustion as it burns with insufficient air. However, a vaporization of the fuel droplets, which are still present, takes place and the desired complete combustion is obtained within combustion chamber 9 by help of the air supplied through the holes 17*a* – 17*d*. The wall of the combustion chamber 9 is protected against the hot combustion gases by the air veil mentioned above which is continuously supplemented by the air entering through the holes 17*a* – 17*d*.

As mentioned above, a rotating cloud of a rich fuel-air mixture is formed in the front zone i.e. the upper part in FIG. 1 of the combustion chamber 9 by the rotating air flow in pre-chamber 18, which cloud at first does not burn completely. If the rotation is too strong fuel droplets may be thrown against the wall of combustion chamber 9 by centrifugal force, which has adverse effect on combustion. On the other hand, it is desired that the combustion air flows along the wall of the combustion chamber 9 with relatively high speed to obtain a good cooling effect. In order to decrease the rotational flow of the air within pre-chamber 18, a radial baffle 21 extending axially from separation 15 is arranged in the annular space 10. This baffle 21 decelerates the air speed in a circumferential direction so that the rotational speed of the fuel-air cloud is decreased. On the other hand, the air flowing along the wall of the combustion chamber 9 is only unessentially influenced by baffle 21 at least in that portion in which the highest heat input takes place.

As shown, the air passage 8 is arranged near the end of the annular chamber 10 opposite to the fuel nozzle 5 so that the combustion chamber 9 is subjected to the air inwardly and outwardly along its whole length. The last row of holes 17*d* is likewise arranged near this end to intensely cool this portion of the combustion chamber wall which is subjected to especially high heat input. An increased supply of air to these holes 17*d* can be obtained by a further radial baffle 22 which extends in an axial direction from the end wall 11. This baffle 22 is arranged approximately opposite to the air intake passage 8 and to the first baffle 21.

Figure 2:
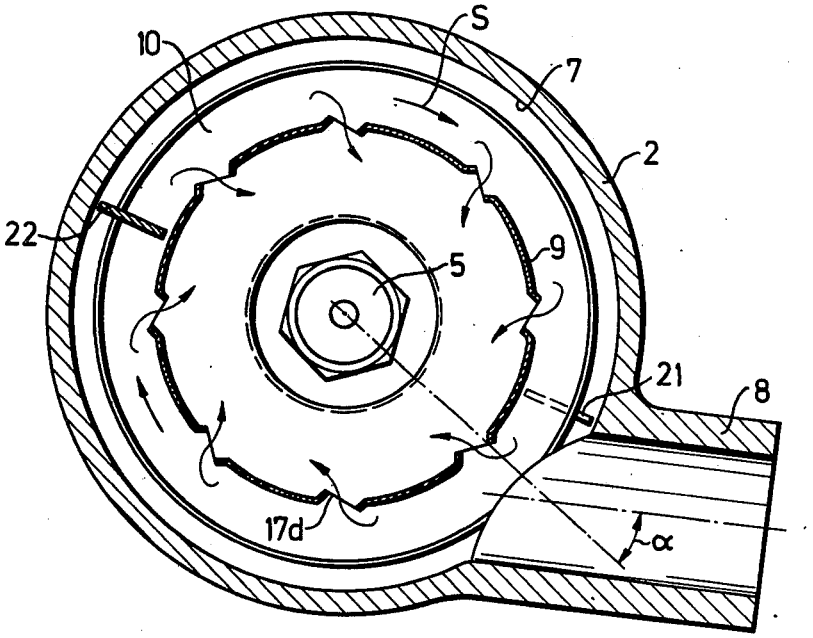
FIG. 2 is a cross sectional view taken along line 2—2 in FIG. 1.
Figure 3:
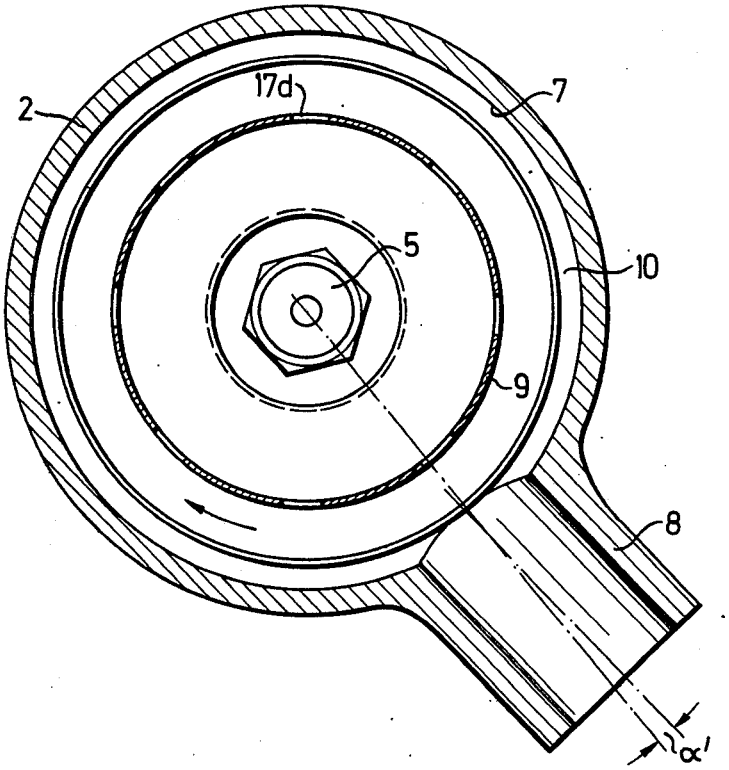
FIG. 3 is a view similar to FIG. 2 showing a modification.

Owing to the intense cooling of the wall of the combustion chamber 9 by an air flow along the inner as well as along the outer surface thereof, the wall thickness may be small and low-alloyed steels can be used. With a combustion chamber with a thin wall, however, the tangential flow within the combustion chamber may become too intensive and the fuel-air-cloud may rotate so fast that fuel droplets may be thrown against the wall of the combustion chamber 9. This effect may be explained by the fact that the air, when passing through the holes 17*a–d* in a thin wall, is almost not deflected in a radial direction as is the case with radial holes in a thick wall. This is taken into account by inclining the holes 17*a–d*, against the direction of rotation S, within annular space 10 as can be seen in FIG. 2. An influence upon the circumferential speed of the air entering the annular space 10 can be obtained by suitable selection of the angle between the longitudinal axis of the air passage 8 and the radial line through the center of the combustion chamber 9 and intersecting said axis at the mouth of the passage 8. If that angle $\alpha$, is large (FIG. 2) the tangential flow is strong. If angle $\alpha'$, is small (FIG. 3) the tangential flow is small enough that the inclination of the holes 17 can be dispensed with and also baffles 21 and 22 can be omitted. This modification is shown in FIG. 3.

The double cone forming the combustion chamber 9 is unsymmetrical, with its biggest diameter 12 lying closer to outlet end 14 than to the end 13 adjacent fuel nozzle 5. By this arrangement, a relatively sudden decrease of the cross-sectional area is obtained which leads to high flow speeds which are desired with high speed or impulse burners. In addition, the time the gases stay in the combustion chamber is short whereby the formation of $NO_x$ is decreased.

The number, size and arrangement of the holes 16 and 17 depends on the size of the burner, of the fuel used and eventually on the field of application.

For changing the air speed, an insert 24, shown diagrammatically in FIG. 1, can be provided within air passage 8, said insert having a passage 25 corresponding to the desired air speed. Therewith the burner can be adapted to different outputs and fields of invention.

The end wall 11 can be made of ceramics or can be a cooled metallic body.

The invention is not limited to the embodiment shown. For example, the invention can be used for a burner for gaseous fuel whereby a perforated distributor plate is used and instead of the atomizing nozzle 5.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What we claim is:

1. A burner for fluid fuels comprising an essentially cylindrical burner housing having an open end and a closed end, the open end being connectible to an exhaust pipe, a fuel supply means in the closed end and arranged in the longitudinal center axis of the housing, a combustion air supply passage in the peripheral wall of the housing, a tubular combustion chamber arranged coaxially within the housing, an annular space between said combustion chamber and the inner peripheral wall of the housing, said space being closed towards the open end of the housing, said combustion chamber having the shape of a double cone having its largest diameter between its ends, said double cone being asymmetrical and having said largest diameter farther away from the end adjacent the fuel supply means than from the other end, a separation between the end of the double cone adjacent the fuel supply means and said peripheral wall to form a prechamber comprising said fuel supply means and an ignition means, said separation being substantially perpendicular to the longitudinal axis of the combustion chamber and separate from the burner housing, holes in said separation and in the wall of the double cone arranged and sized to form a rich fuel-air mixture in the prechamber, said air supply passage opening into said annular space with its longitudinal axis including an angle with a radial line passing through the center of the combustion chamber and the intersection between the longitudinal axis of said passage and the inner peripheral wall of the housing, thereby maintaining the flow of air in a helical path along the outer surface of the combustion chamber, a part of this air entering the holes of the combustion chamber and assuring a rotational path of travel forming an air veil along the inner surface of said combustion chamber.

2. A burner as claimed in claim 1 and including at least one axially extending baffle within said annular space.

3. A burner as claimed in claim 2 wherein a first baffle extends from said separation.

4. A burner as claimed in claim 1 wherein the wall of the combustion chamber is made of thin sheet metal with the holes therein being inclined against the direction of rotation of the air within said annular space.

5. A burner as claimed in claim 1 wherein the air supply passage opens into the annular space near the end thereof opposite to the fuel supply means and wherein circumferentially spaced holes are provided in the wall of the combustion chamber near the end thereof opposite to the fuel supply means.

6. A burner as claimed in claim 1 wherein an insert is provided in the air passage to obtain desired air speeds entering the annular space, said insert having a passage corresponding to the desired air speed and thereby enabling the burner to be used for a variety of outputs by only changing the insert.

7. A burner as claimed in claim 1 wherein said angle between the longitudinal axis of the air supply passage and the radial line passing through the center of the combustion chamber is small enough to substantially prevent fuel droplets from being thrown against the wall of the combustion chamber.

8. A burner for fluid fuels comprising an essentially cylindrical burner housing having an open end and a closed end, the open end being connectible to an exhaust pipe, a fuel supply means in the closed end and arranged in the longitudinal center axis of the housing, a combustion air supply passage in the peripheral wall of the housing, a tubular combustion chamber arranged coaxially within the housing, an annular space between said combustion chamber and the inner peripheral wall of the housing, said space being closed towards the open end of the housing, said combustion chamber having the shape of a double cone having its largest diameter between its ends, a separation between the end of the double cone adjacent the fuel supply means and said peripheral wall to form a prechamber comprising said fuel supply means and an ignition means, holes in said separation and in the wall of the double cone arranged and sized to form a rich fuel-air mixture in the prechamber, said air supply passage opening into said annular space with its longitudinal axis including an angle with a radial line passing through the center of the combustion chamber and the intersection between the longitudinal axis of said passage and the inner peripheral wall of the housing, thereby maintaining the flow of air in a helical path along the outer surface of the combustion chamber, a part of this air entering the holes of the combustion chamber and assuring a rotational path of travel forming an air veil along the inner surface of said combustion chamber, the burner further including a first baffle extending within the annular space from said separation, and a second baffle extending from the wall which closes the annular space at the end opposite to the fuel supply means.

9. A burner as claimed in claim 8 wherein said second baffle is arranged diametrically opposite to said first baffle.

10. A burner as claimed in claim 8 wherein said second baffle is arranged approximately diametrically opposite to said air supply passage.

* * * * *